US005651198A

United States Patent [19]

Sussmann

[11] Patent Number: 5,651,198

[45] Date of Patent: Jul. 29, 1997

[54] SHOE, ESPECIALLY A SPORT SHOE

[75] Inventor: Reinhold Sussmann, Scheinfeld, Germany

[73] Assignee: Puma AG Rudolf Dassler Sport, Germany

[21] Appl. No.: 628,735

[22] PCT Filed: Dec. 26, 1993

[86] PCT No.: PCT/DE93/01257

§ 371 Date: Apr. 15, 1996

§ 102(e) Date: Apr. 15, 1996

[87] PCT Pub. No.: WO95/10201

PCT Pub. Date: Apr. 20, 1995

[30] Foreign Application Priority Data

Oct. 14, 1993 [DE] Germany ..... 93 15 640.5

[51] Int. Cl.[6] ..... A43B 11/00; A43C 11/20

[52] U.S. Cl. ..... 36/50.1; 36/50.5; 36/54

[58] Field of Search ..... 36/50.1, 50.5, 36/54

[56] References Cited

U.S. PATENT DOCUMENTS 5,425,185 6/1995 Gansler ..... 36/50.1

5,463,822 11/1995 Miller ..... 36/50.1

5,502,902 4/1996 Susmann ..... 36/50.1

5,511,325 4/1996 Hieblinger ..... 36/50.1

*Primary Examiner*—Paul T. Sewell

*Assistant Examiner*—Anthony Stashick

*Attorney, Agent, or Firm*—Sixbey, Friedman, Leedom & Ferguson, P.C.; David S. Safran

[57] ABSTRACT

A shoe (1) with a central turn-lock fastener (5) and deflecting elements (9) for the tensioning element (7) is designed in such a way that mounting, and if required dismounting, of the tensioning elements (7) are made substantially easier. For that purpose, the deflecting elements (9) are provided at their front faces (13) with a groove (15) for the tensioning element (7). The groove is deeper than the thickness of the tensioning element (7). A locking member (18) with a rising flank (19) is provided on at least one side (17) of the groove. The highest point (20) of the rising flank (19) is in the vicinity of the opposite side (21) of the groove, so that the remaining gap is smaller than the thickness (23) of the tensioning element (7).

10 Claims, 1 Drawing Sheet

FIG. 1
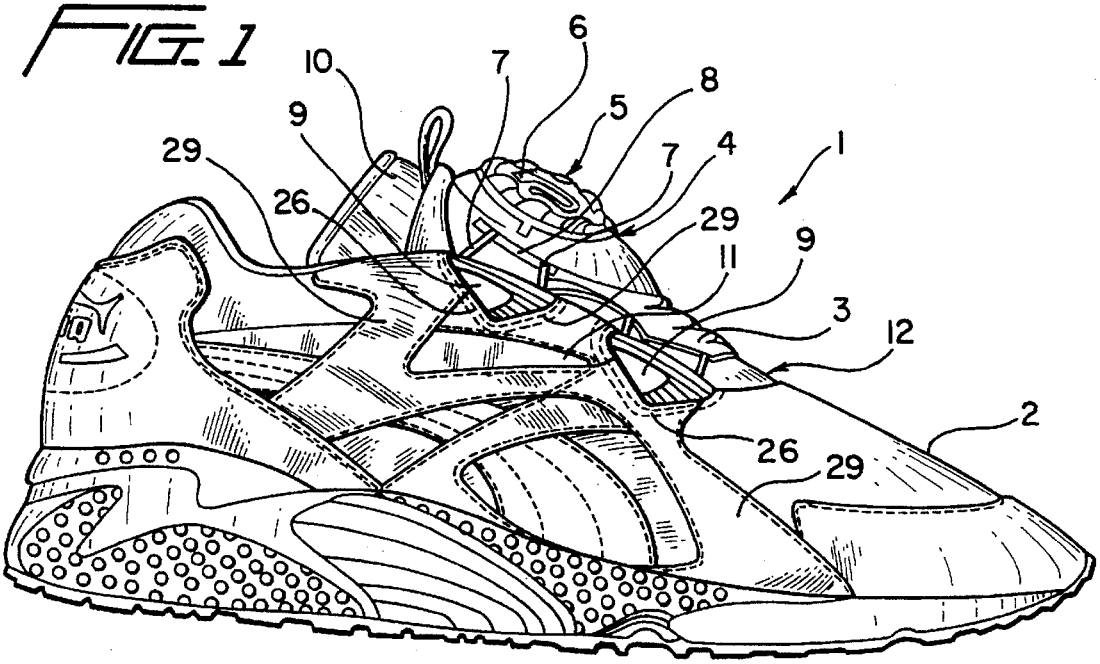
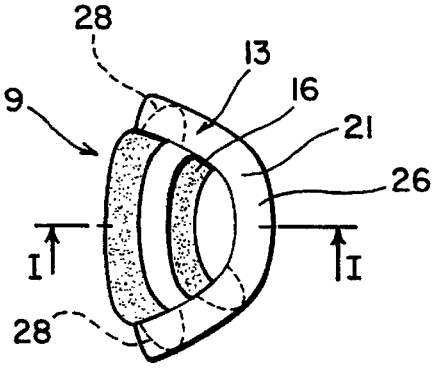
FIG. 2
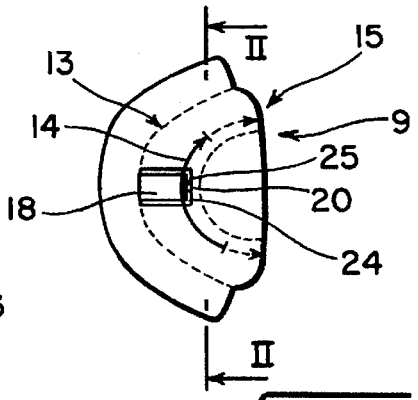
FIG. 3
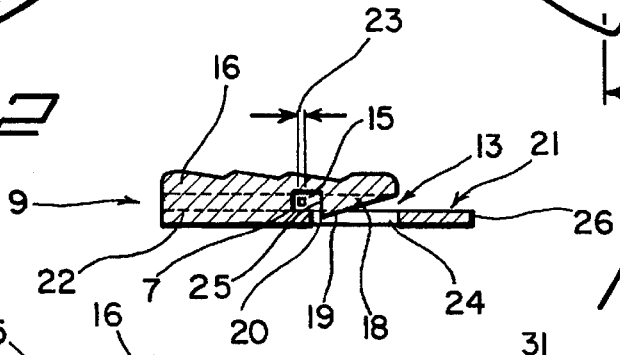
FIG. 4
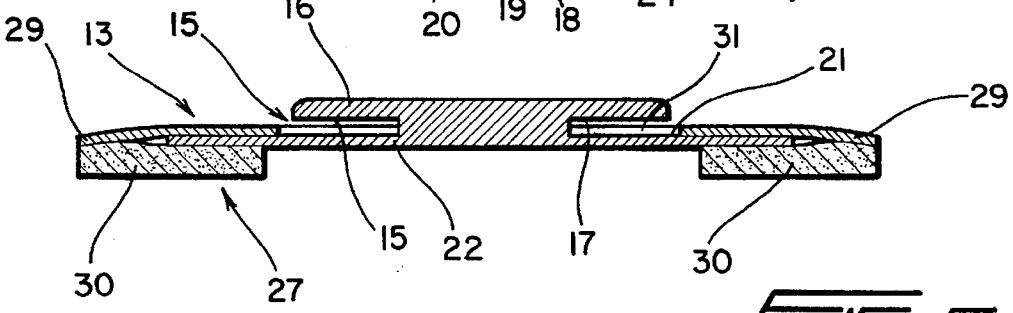
FIG. 5

SHOE, ESPECIALLY A SPORT SHOE

BACKROUND OF THE INVENTION

1. Field of the Invention

This invention relates to a shoe, especially sport shoe, with a closing device using a rope-like or strap-like tightening element, which can be tightened between at least one defelecting element provided on each of two shoe parts to be braced against one another.

2. Description of Related Art

Such a shoe is known from German Patent Application 23 17 408. The deflecting elements for the rope-like tightening element are made there as deflecting rollers and are mounted in roller carriers that can be fastened to the shoe upper or to an instep cover. The tightening rope must be inserted there through the interspace present between the fastening point of the roller carrier and the deflecting roller. This type of assembly is therefore difficult and time-consuming.

SUMMARY OF THE INVENTION

With this invention, the object to be achieved is to configure and to make possible, respectively, the deflecting elements and their fastening to the shoe upper, so that the assembly as well as the optional detaching of the tightening element is substantially simplified. Also, an efficient production of the deflecting elements is to be made possible.

This object is achieved by the features wherein each deflecting element, has a disk or plate shape which is provided with a groove for a tightening element on its front surface, at least in the area in which the tightening element imparts its gripping power, the groove depth or cross section being greater than the thickness or the cross section of the tightening element. Furthermore, a latching member is provided on at least one side of the groove which has a sloping side which rises in an outward direction away from the groove, a lowest, innermost point on said sloping side being at a distance relative to an opposite side of the groove that is less than a thickness of the tightening element. This latching member can be deflected away from the groove wall in an elastically springy manner relative to opposite groove wall (21), so that tightening element (7) can snap into and engage in the groove over the sloping side of the latching member, whereby the tightening element is then movably guided in the groove.

With the configuration of the deflecting elements according to the invention, a very quick undetachable suspension of the tightening element, but also a simple removal of it, is possible. Furthermore, the deflecting element can consist of a simple plastic molded part, which can be produced efficiently as a complete unit and can be fastened to the shoe.

Other advantageous details of the invention are described in more detail below based on the embodiment represented in the drawing.

BRIEF DESCRIPTION OF THE DRAWINGS

FIG. 1 A shoe with a rotary closing device in a side view,

FIG. 2 shows a deflecting element according to this invention in the top view, FIG. 3 shows the deflecting element of FIG. 2 in a view from below, FIG. 4 shows a view corresponding to section I—I of FIG. 2 and FIG. 5 shows a view corresponding to section II—II of FIG. 3.

In FIG. 1, a shoe, especially a sport shoe, is designated with 1. On instep 2, a rotary closing device 5 is attached to a support 3 in an indentation 4. By rotating its rotary disk 6, a rope pulley an provided inside the rotary closing device 5 can be rotated. A rope-like or strap-like tightening element 7 is connected with the rope pulley, element which is brought out laterally from openings 8 of support 3, for example, in the form of loops, and is guided to deflecting elements 9. Preferably, such openings 8 are provided respectively on two sides opposite one another or almost opposite sides of support 3, thus here, respectively, on the left side and on the right side. In the arrangement of rotary closing device 5 on the lateral upper, they can be provided there also in the front or in the rear.

Support 3 can be attached to shoe 1 to pivot in an opening direction or can be tightly connected with tongue 10. It can also be attached laterally to shoe 1, to a shoe upper part or the like.

Deflecting elements 9 are provided, for example, on a shoe part closing shoe 1, for example, on lateral upper parts 11 and 12, which can be tightened in the closing direction.

According to FIGS. 2 to 5, on front surface 13, preferably in an area 14, in which tightening element 7 is effective, the especially disk-like or plate-like deflecting elements 9 have a deep groove 15, in which tightening element 7 is smoothly guided.

The depth of groove 15 or of its free cross section is greater than the thickness or the cross section of rope-like tightening element 7.

On upper deflecting partial section 16 of deflecting element 7, a latching member 18, for example, in the form of a detent with a side 19 sloping downward in an inward direction, is provided on groove side 17 formed by the deflecting partial section 16. In the embodiment, latching member 18 runs completely inside groove 15. But, it can also extend only partially into groove 15 or only adjoin the latter.

A lowermost point 20 of the sloping side 19 of latching member 18 has come at least so near to the opposite groove side 21 of lower deflecting partial section 22 that a possible remaining gap is smaller than thickness 23 of rope-like tightening element 7 or is smaller than the smallest thickness of any possible strap-like tightening element 7. In the embodiment, lowermost point 20 projects at least partially into a recess 24 of groove side 21 or of lower deflecting partial section 22.

By an elastically springy design of lower deflecting partial section 22 and/or of upper deflecting partial section 16 or a correspondingly effective part of these sections 16, 22, latching member 18 can be deflected in an elastically springy manner relative to groove side 21, so far that tightening element 7 can snap into groove 15 during gripping by side 19. By steep inside edge 25, after the rebounding of the parts deflected in an elastically springy manner, tightening element 7 is held easily movable in its position.

Latching member 18 thus acts similar to a springy lever of a snap hook.

Lower deflecting partial section 22 can, as shown in the embodiment, comprise a flange 26 projecting laterally beyond the contour of upper deflecting partial section 16, with which deflecting element 9 is fastened, sewn on or in another suitable way, such as by gluing, to shoe 1, for example, to an upper part 27.

Instead of a continuous flange 26, two or more tabs 28 can also be provided, as is indicated by a broken line in FIG. 2.

Flange 26 or tabs 28 can be designed so that, as represented, for example, in FIG. 1, in deflecting elements 9 arranged side by side to one another on one side, flanges 26 touch or even overlap. As a result, a greater stiffness of the "eyelet strip" is obtained.

Preferably, flange 26 or tabs 28 are arranged concealed, e.g., between a trim 29 and upper material 30, as is indicated in FIGS. 1 and 5. Suitably in this case, trim 29 has a recess 31, which corresponds at least approximately to the outline shape of upper deflecting partial section 16.

Deflecting elements 9 preferably have a disk or plate shape. Thus, in area 14, in which tightening element 7 imparts its gripping power, a guiding with little friction of tightening element 7 in this area is made possible. If this requirement must not be met optimally, deflecting elements 9 could also have another geometric shape with smaller deflecting radii for tightening element 7.

I claim:

1. Sport shoe with a closing device using a rope-shaped tightening element tightenable between at least one deflecting element provided on each of two shoe parts to be braced against one another; wherein each deflecting element has a disk or plate shape in which a groove is provided on a front surface thereof, at least in an area in which the tightening element imparts a gripping force on the deflecting element, for slidably guiding the tightening element; wherein said groove has at least a depth which is greater than a thickness of the tightening element; wherein a latching member is provided at least on one side of the groove, said latching member having a sloping side which rises in an outward direction away from the groove and a lowermost point of said sloping side being at a distance relative to an opposite side of the groove which is smaller than the thickness of the tightening element; and wherein the latching member is elastically deflectable in a direction away from the opposite side of the groove wall in a springy manner enabling the tightening element to pass over the sloping side of the latching member and then snap into and engage in the groove.

2. Shoe according to claim 1, wherein the latching member comprises a snap hook closure member.

3. Shoe according to claim 1, wherein a recess is provided in said deflecting element at said opposite side of the groove, said latching member being at least partially received in said recess in an undeflected state.

4. Shoe according to claim 1, wherein the deflecting element has at least one laterally projecting tab or flange as a means for attaching the deflecting element to the shoe.

5. Shoe according to claim 4, wherein said at least one tab or flange comprises a plurality of flanges or tabs arranged side-by-side tightly adjacent to one another.

6. Shoe according to claim 4, wherein said at least one tab or flange is attached between an upper of the shoe and a trim piece on the upper.

7. Shoe according to claim 6, wherein the trim has a recess matched to an outline shape of deflecting element.

8. Shoe according to claim 1, wherein a rotary closing device is attached to shoe, said closing device having a rope pulley for winding and unwinding the tightening element and which comprises a support which has at least one outlet for a loop of the tightening element on each of opposite sides of the shoe, and wherein each loop is suspended in a groove of a respective deflecting element.

9. Shoe according to claim 8, wherein the support is pivotally attached to shoe in a manner enabling it to be pivoted away from a throat opening of the shoe.

10. Shoe according to claim 8, wherein the support is fastened to one of a tongue, an upper part or an instep portion of the shoe.

* * * * *